US005374171A

United States Patent [19]

Cooksey

[11] Patent Number: 5,374,171

[45] Date of Patent: Dec. 20, 1994

[54] ROTARY COMPRESSOR THRUST WASHER

[75] Inventor: Edward A. Cooksey, Adrian, Mich.

[73] Assignee: Tecumseh Products Company, Tecumseh, Mich.

[21] Appl. No.: 225,531

[22] Filed: Apr. 11, 1994

[51] Int. Cl.[5] ..... F01C 1/02

[52] U.S. Cl. ..... 418/63; 418/77

[58] Field of Search ..... 418/63, 75, 77, 79, 418/80, 248

[56] References Cited

U.S. PATENT DOCUMENTS

| | | | |
|---|---|---|---|
| 522,102 | 6/1894 | Brown . | |
| 603,679 | 10/1898 | Drake . | |
| 823,228 | 6/1906 | Shepard . | |
| 1,442,828 | 1/1923 | Rotermund . | |
| 2,452,253 | 10/1948 | McGill . | |
| 2,864,552 | 12/1958 | Anderson . | |
| 3,139,036 | 6/1964 | McGill | 418/63 |
| 3,343,782 | 9/1967 | Brewer . | |
| 3,767,333 | 10/1973 | Ashikian . | |
| 3,912,427 | 10/1975 | Eckerle . | |
| 3,945,776 | 3/1976 | Morita . | |
| 4,927,339 | 5/1990 | Riffe et al. . | |
| 4,958,993 | 9/1990 | Fujio . | |
| 5,116,208 | 5/1992 | Parme | 418/63 |

FOREIGN PATENT DOCUMENTS

| | | | |
|---|---|---|---|
| 4342892 | 11/1992 | Japan | 418/63 |

*Primary Examiner*—Richard A. Bertsch
*Assistant Examiner*—Charles G. Freay
*Attorney, Agent, or Firm*—Baker & Daniels

[57] ABSTRACT

A rotary compressor including an orbiting piston is disposed within a cylinder bore. A crankshaft with an eccentric causes the piston to orbit within the cylinder block. Crescent shaped polymeric washers are interfit between the eccentric and cylinder bore endwalls to reduce friction and endplay therebetween. Curved or whorled grooves on the face of the washer reduce frictional contact area and at the same time increase lubricant flow. Compressor noise is reduced by the ability of the washers to act as resilient stops between the eccentric, crankshaft and cylinder endwalls.

15 Claims, 2 Drawing Sheets

ROTARY COMPRESSOR THRUST WASHER

BACKGROUND OF THE INVENTION

This invention pertains to hermetic rotary compressors for compressing refrigerant in refrigeration systems such as refrigerators, freezers, air conditioners and the like. In particular, this invention relates to reducing frictional loading of the crankshaft and eccentric.

In general, prior art rotary hermetic compressors comprise a housing in which are disposed a motor and compressor cylinder block. The motor drives a crankshaft for revolving a rotor or roller (piston) inside the cylinder. One or more vanes are slidably received in slots located through the cylinder walls for separating areas at suction and discharge pressure within the cylinder bore. The vanes, cooperating with the rotor and cylinder wall, provide the structure for compressing refrigerant within the cylinder bore.

The operating parts of rotary hermetic compressors are machined to extremely close tolerances and the surfaces of the parts are finished to a high degree in order to prevent leakage and thereby provide a very efficient compressor. Preventing leakage of refrigerant from high pressure areas to low pressure areas is of main concern to increasing compressor efficiency.

One of the problems encountered in prior art hermetic compressor arrangements has been high frictional loading between the vane tip and the rolling piston, and between the piston and the cylinder wall. The vane necessarily has to be highly loaded against the piston to prevent compressed refrigerant leakage. At times, insufficient oil reaches the critical wear areas of the vane tip and piston, thereby increasing the wear rate of each. A reduction in the frictional loading on the vane tip would reduce wear and increase compressor efficiency. Additional sources of wear and friction are at the interface of the outboard or inboard bearings and the eccentric within the cylinder block.

U.S. Pat. No. 3,343,782 discloses a rotor having washer like elements secured to each end of the rotor by endplates. These washer like elements are flexible carbon washers which provide bearing surfaces between the endwalls of the rotor and housing. A problem with this structure is that it requires grinding the faces of the washers to eliminate burrs. Further, the washer elements do not assist in oil migration between the rotor and housing endwalls thereby possibly increasing the noise of the compressor.

U.S. Pat. No. 2,864,552 shows a bearing plate for a shaft having a multi-start spiral groove extending across the central portion of the plate. This groove is used to maintain a charge of air pressure to the bearings but is not used specifically for transfer of oil to sliding surfaces. A potential problem with this end plate is that its shape does not control endplay of the shaft.

An additional problem encountered with vertical shaft rotary compressors is an inherent axial crankshaft load caused by the vertical orientation of the crankshaft. Misalignment of the axial position of the rotor relative to the stator is a major source of eccentric side journal loading. The stator, when energized, attempts to center the rotor in the stator iron. Depending on the rotor position, this net force may be upward or downward. This load causes increased friction between portions of the crankshaft and bearings that slide together, specifically the eccentric side journals of the crankshaft eccentric that slide against the cylinder block endwalls.

This increased frictional wear reduces the efficiency of the compressor.

SUMMARY OF THE INVENTION

The present invention overcomes the disadvantages of the above described prior art rotary compressors by providing a polymer thrust washer between the faces of the eccentric of the crankshaft and the cylinder block, to thereby distribute the axial crankshaft load and simplify crankshaft machining.

More specifically, the invention provides two crescent shaped polymer washers fitted to the face surfaces of the crankshaft eccentric. Each polymer washer engages both the crankshaft eccentric and an end wall of the cylinder block. The faces of the washers are provided with whorled or curved grooves to distribute oil and reduce friction contact area. By controlling the washer thickness, crankshaft endplay can additionally be controlled.

An advantage of the rotary compressor of the present invention is that the two crescent shaped polymer washers distribute crankshaft load evenly, thereby reducing localized high stress areas and leading to longer compressor life.

Another advantage of the rotary compressor of the present invention is that the polymer washers reduce sound emanating from the compressor by eliminating the sound of the eccentric moving against the cylinder block endwalls.

Yet another advantage of the rotary compressor of the present invention is that the polymer washers simplify crankshaft machining by eliminating the necessity of grinding the face of the intermittent thrust surface of the crankshaft (eccentric face surface) and the removal of burrs created by the grinding process.

The invention, in one form thereof, provides a rotary compressor having a cylinder block assembly disposed within a housing. The cylinder block assembly includes a bore with a sidewall and endwall. A roller piston for compressing fluid is located within the bore connected to a drive mechanism by a crankshaft disposed within the bore. The crankshaft further includes an eccentric portion having an axial face, the roller piston disposed about the eccentric portion. A crescent shaped washer is disposed between the eccentric axial face and the cylinder block assembly endwall whereby the washer reduces friction and endplay between the crankshaft and endwall.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
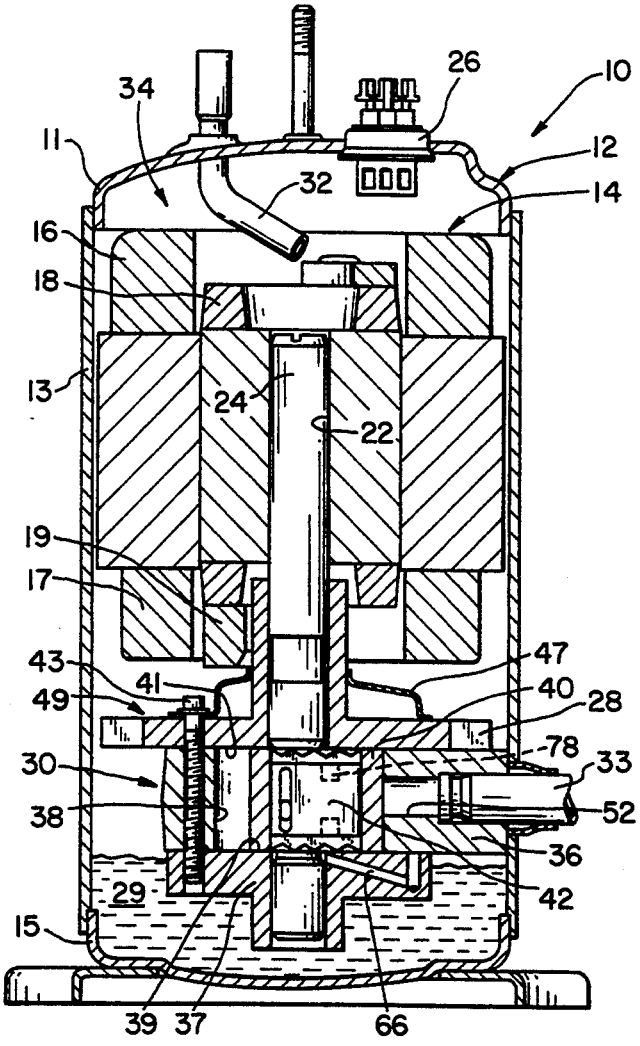
FIG. 1 is a longitudinal section view of a typical rotary compressor incorporating one form of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings and in particular by referring to FIG. 1, a compressor 10 is shown having a housing 12. The housing 12 has a top portion 11, a central portion 13, and a bottom portion 15. The three housing portions are hermetically secured together as by welding or brazing.

Located inside hermetically sealed housing 12 is a motor generally designated at 14 having a stator 16 and rotor 18. The stator 16 is provided with windings 17. The stator 16 is secured to housing 12 by an interference fit such as by shrink fitting. The rotor 18 has a central aperture 22 provided therein into which is secured a crankshaft 24 by an interference fit, and a counterweight 19 is attached to rotor 18. A terminal cluster 26 is provided on top portion 11 of compressor 10 for connecting motor 14 to a source of electric power. An inboard bearing or frame member 28 is attached to housing 12 below motor 14 by an interference fit or welding. An oil sump 29 is located in a portion of housing 12 to provide a supply of lubricant to compressor mechanism 30 attached to inboard bearing 28.

Compressor mechanism 30 is attached to both inboard bearing 28 and housing 12. Although shown below motor 14, compressor mechanism 30 may alternatively be located above motor 14. A refrigerant discharge tube 32 extends through the top portion 11 of the housing and has an end thereof extending into the interior 34 of compressor housing 12 as shown in FIG. 1. Discharge tube 32 is sealingly connected to housing 12 by soldering. Similarly, a suction tube 33 extends into the interior of compressor housing 12 (FIG. 1) into a suction port 52.

Figure 2:
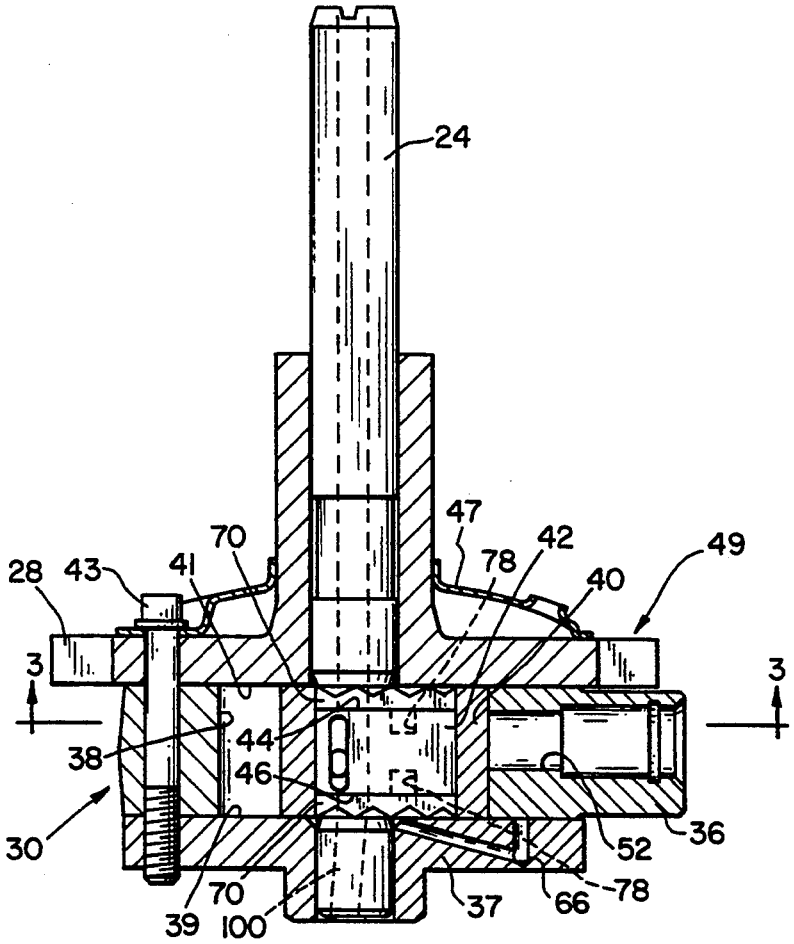
FIG. 2 is an enlarged sectional view of the crankshaft and cylinder block of the compressor of FIG. 1.

As shown in FIG. 2, compressor mechanism 30 comprises a cylinder block 36 having a bore 38 in which a piston or roller 40 is disposed. Outboard bearing 37, forming an endwall 39, is attached axially outward to one side of cylinder block 36 while on the other side is inboard bearing 28 forming another endwall 41. Together, inboard bearing 28, cylinder block 36 and outboard bearing 37 form a cylinder block assembly 49. Bore 38 and endwalls 39 and 41 define the compression space for compressor mechanism 30. Endwall 39, on outboard bearing 37, rotatably supports crankshaft 24, at a distal end thereof, as more fully described below.

Compressor cylinder block 36, inboard bearing 28 and outboard bearing 37 are attached together by means of bolts 43, one of which is shown in FIG. 1. By referring to FIG. 2, it can be seen that a plurality of clearance holes 45 are provided in cylinder block 36, for securing together bearings 28, 37 and cylinder block 36. A discharge muffler plate 47 is secured to inboard bearing 28 by bolts 43 as indicated in FIG. 1.

Crankshaft 24 is provided with an eccentric 42 which revolves around the crankshaft axis as crankshaft 24 is rotatably driven by motor 14. Located within piston 40, eccentric 42 is formed as a portion of crankshaft 24. Alternatively, eccentric 42 may comprise a separate member that bolts on or attaches to crankshaft 24. Eccentric 42 includes a substantially planar top axial face surface 44 and a substantially planar bottom axial face surface 46 each facing endwalls 39 and 41 of mechanism 30. In previous rotary compressors, top surface 44 or bottom surface 46 would sometimes slide against endwall 39 creating friction within compressor 10.

Figure 3:
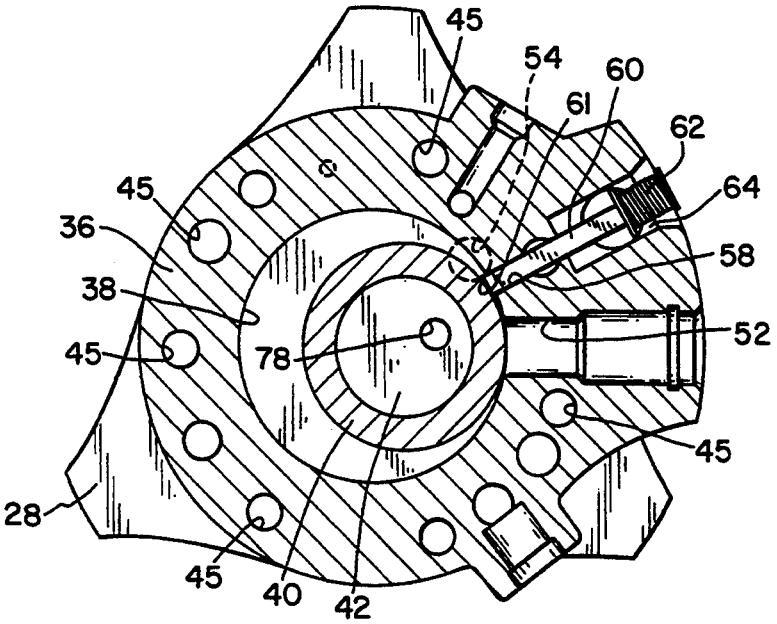
FIG. 3 is a sectional view of the cylinder block along line 3—3 of FIG. 2 and viewed in the direction of the arrows.

As shown in FIGS. 2 and 3, within cylinder block 36 is a suction port 52 connecting with cylinder bore 38, and a discharge port 54, also communicating with bore 38. Suction port 52 is interfit with a suction tube 33, that draws refrigerant from the evaporator of a refrigeration system (not shown). Discharge port 54 is in communication with the interior 34 of compressor 10 past a discharge valve (not shown). Compressor interior 34 is further in communication with an associated refrigerant system (not shown) through discharge tube 32.

By referring to FIG. 3, it can be seen that cylinder block 36 includes a vane slot 58 provided in cylindrical sidewall 38 thereof, into which is received a sliding vane 60. The tip 61 of sliding vane 60 is in continuous engagement with piston 40 since vane 60 is urged by a spring 62 received in spring pocket 64. During operation, as piston 40 rolls within cylinder bore 38, refrigerant will enter bore 38 through the suction port 52. Next, the compression volume enclosed by piston 40, cylinder bore 38, and sliding vane 60 decreases in size as piston 40 moves clockwise within bore 38. Refrigerant contained in that volume will therefore be compressed and exit through discharge port 54. The aforementioned compressor mechanism is presented by way of example only, it being contemplated that other piston means for compressing gas within bore 38 may be used without departing from the spirit and scope of the present invention.

A conventional centrifugal oil pump 100 is operatively associated with the end of crankshaft 24, which is submerged in oil sump 29. During operation, oil pump 100 pumps lubricating oil upwardly through an oil passage 66 extending longitudinally from the crankshaft.

Figure 4:
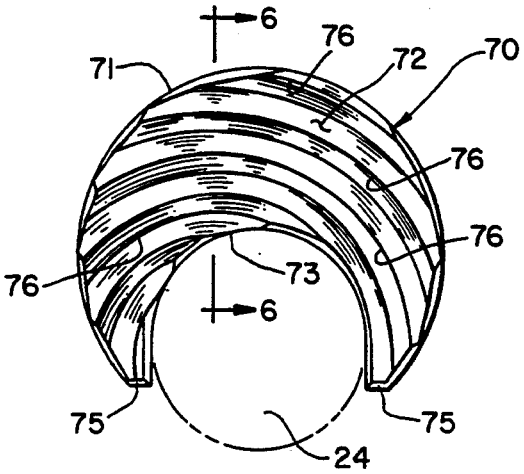
FIG. 4 is a plan view of the thrust washer of the present invention about a crankshaft.

The present invention, in one form thereof, incorporates a crescent shaped polymer washer 70 as shown in FIG. 4. Circular outside edge 71 is generally slightly smaller in diameter than eccentric 42 so as not to interfere with piston 40. Inside edge 73 of washer 70 is circular in shape and generally encircles crankshaft 24 when washer 70 is attached to eccentric 42. Outside edge 71 and inside edge 73 are of different radii, but are connected at points 75, thereby forming the crescent shape of washer 70. A crescent washer 70 is fitted onto each of the planar ends 44, 46 of eccentric 42 (FIG. 2). Each washer 70 includes an outward face surface 72 and inward face surface 74. The terms outward and inward relate to directions away and toward eccentric 42 respectively.

As shown in FIG. 4, outward face surface 72 of washer 70 includes a plurality of whorled or curved grooves 76 thereon. Other types of grooves such as reverse knurl, radial grooves, diamond pattern, curved grooves in different directions, or others could be used to reduce contact area. One purpose of the curved grooves is to distribute or smear oil across the end wall surface. The whorled or curved grooves shown in FIG.

4 are the preferred type for maximum oil distribution. These grooves 76 assist in distributing oil between washer 70 and endwalls 39 and 41 of compressor mechanism 30. No other changes in the lubrication system are necessary to increase oil flow. The other portions of the lubrication system are known from U.S. Pat. No. 5,022,146, assigned to the assignee of the present invention and expressly incorporated herewith. Curved grooves 76 in the outward face surface 72 of washers 70 further reduce friction between eccentric 42 and endwalls 39 and 41 since the contact area between the eccentric 42 and endwalls 39 and 41 as reduced.

Figure 6:
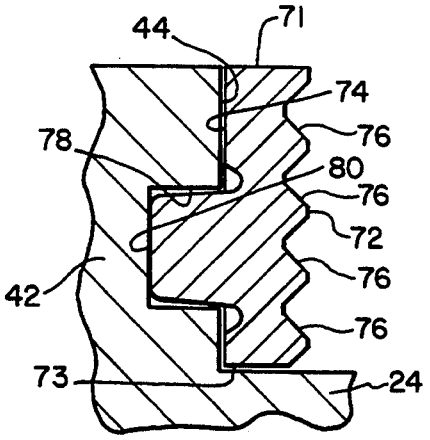
FIG. 6 is a sectional view of the thrust washer of the present invention, taken along line 6—6 of FIG. 4 and viewed in the direction of the arrows.
Figure 5:
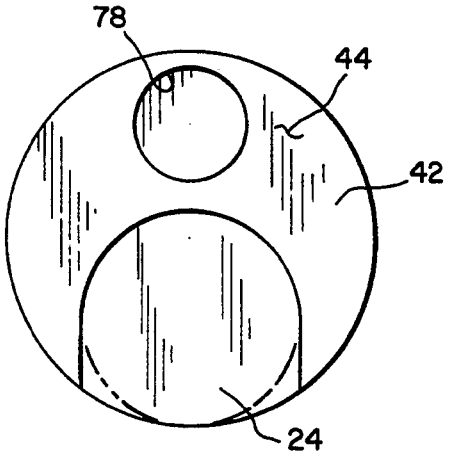
FIG. 5 is a plan view of the eccentric to which the present invention attaches.

FIGS. 5 and 6 disclose how washers 70 are preferably attached to eccentric 42. A recess 78 is formed in the planar surface of eccentric 42 for attachment of washer 70 to eccentric 42. Although recess 78 is shown as a blind circular bore, alternatively recess 78 may comprise other shapes to locate washer 70 on eccentric 42. Crescent washer 70 has a projection 80 on inward face surface 74. When assembled, projection 80 is disposed within recess 78 to prevent washer 70 from sliding on eccentric 42. Washer 70 is held in place by projection 80 and by inside edge 73 that engages about crankshaft 24. Alternatively, other attachment methods for attaching washers 70 to crankshaft 24 and eccentric 42 may be used. Further, the projection and recess may be mechanically reversed so that a portion of eccentric 42 interfits within washer 70.

The attachment of washers 70 to crankshaft 24 and eccentric 42 eliminates the need to surface grind the surfaces of crankshaft 24 or eccentric 42 that contacted endwalls 39 and 41 in the past.

Washers 70 are formed out of a high strength plastic polymer such as Teflon (PTFE), Vespel (Polyimide) or other polymers with various lubricity additives. Other materials for washers 70 could also be utilized. By using a polymer material, noise associated with crankshaft 24 moving between the two surfaces of cylinder block 36 is reduced. Further, washers 70 operate as resilient bumpers to control shocks and reducing noise between crankshaft 24 and compressor mechanism 30. By controlling the thickness of washer 70, crankshaft endplay is additionally controlled. Depending on the specific tolerances of compressor mechanism 30, piston 40, and crankshaft 24, washers 70 may be made thicker or thinner to thereby reduce crankshaft endplay. The use of washer 70 helps to distribute the crankshaft axial load evenly with increased lubrication, reducing high stress areas thereby leading to a longer compressor life.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rotary compressor comprising:

a housing;

a cylinder block assembly disposed within said housing, said cylinder block assembly having an endwall and a bore forming a sidewall;

a roller disposed within said bore for compressing fluid;

a drive mechanism disposed within said housing for actuation of said roller, said drive mechanism including a crankshaft attached to said roller and being at least partially located within said bore, said crankshaft having an eccentric portion including an axial face, said roller disposed about said eccentric piston; and a crescent shaped washer disposed between said eccentric axial face, and said cylinder block assembly endwall, whereby said washer reduces friction and endplay between said crankshaft and said endwall.

2. The compressor of claim 1 in which said crescent shaped washer includes grooves thereon to reduce frictional contact area with said endwall.

3. The compressor of claim 2 in which said grooves on said crescent shaped washer are curved.

4. The compressor of claim 2 in which said eccentric includes one of a recess and a projection, said crescent shaped washer having the other of said recess and said projection, said crescent shaped washer attached to said eccentric by said projection engaging within said recess.

5. The compressor of claim 4 in which said washer is constructed of a plastic polymer.

6. A rotary compressor comprising:

a housing;

a cylinder block assembly disposed within said housing, said cylinder block assembly having a bore with a sidewall, and an endwall;

a crankshaft having an eccentric axial face located within said bore;

a drive mechanism disposed within said housing for actuation of said crankshaft within said bore to compress fluid; and a washer having an outward face and an inward face, said washer disposed between said eccentric axial face and said endwall with said outward face engaging said endwall, said outward face having a plurality of grooves, whereby said washer reduces friction and endplay between said crankshaft and said endwall.

7. The compressor of claim 6 in which said grooves are curved.

8. The compressor of claim 6 in which said washer is crescent shaped.

9. The compressor of claim 6 in which said washer is constructed of a plastic polymer.

10. The compressor of claim 6 in which said eccentric axial face includes a recess, said washer having a projection on said inward face, said washer attaching to said eccentric axial face by said projection engaging said recess.

11. The compressor of claim 10 in which said washer is constructed of a plastic polymer.

12. The compressor of claim 10 in which said washer is crescent shaped.

13. A rotary compressor comprising:

a housing;

a cylinder block assembly disposed within said housing, said cylinder block assembly having a bore with a sidewall, said cylinder block assembly further including an endwall;

a piston located within said bore;

a drive mechanism disposed within said housing for actuation of said piston within said bore to compress fluid, said drive mechanism including a crankshaft with an eccentric, said eccentric engaging said piston; and a crescent shaped washer having an outward face and an inward face, said washer attached to said eccentric and disposed between said eccentric and said endwall with said outward face engaging said endwall, said outward face having a plurality of grooves, whereby said washer reduces friction and endplay between said eccentric and said endwall.

14. The compressor of claim 13 in which said eccentric includes one of a recess and a projection, said washer having the other of said recess and said projection, said washer attaching to said eccentric by said projection engaging said recess.

15. The compressor of claim 13 in which said washer is constructed of a plastic polymer.

* * * * *